US007823997B2

(12) United States Patent
Sakurai

(10) Patent No.: US 7,823,997 B2
(45) Date of Patent: Nov. 2, 2010

(54) DROPLET EJECTION DEVICE

(75) Inventor: Hisaki Sakurai, Aichi-ken (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 92 days.

(21) Appl. No.: 12/286,940

(22) Filed: Oct. 3, 2008

(65) Prior Publication Data

US 2009/0091593 A1 Apr. 9, 2009

(30) Foreign Application Priority Data

Oct. 9, 2007 (JP) ..... 2007-262903

(51) Int. Cl.
*B41J 29/38* (2006.01)
*B41J 2/165* (2006.01)

(52) U.S. Cl. ..... 347/9; 347/24; 347/31

(58) Field of Classification Search ..... None
See application file for complete search history.

(56) References Cited

U.S. PATENT DOCUMENTS 6,932,456 B2 * 8/2005 Kanaya et al. ..... 347/29

FOREIGN PATENT DOCUMENTS

| | | |
|---|---|---|
| JP | 2000-141713 | 5/2000 |
| JP | 2005-111666 | 4/2005 |
| JP | 2006-168177 | 6/2006 |
| JP | 2007-136819 | 6/2007 |

* cited by examiner

*Primary Examiner*—Omar Rojas
(74) *Attorney, Agent, or Firm*—Frommer Lawrence & Haug LLP

(57) ABSTRACT

A droplet ejection device includes a carriage capable of moving back and forth, a droplet ejection head which is mounted on the carriage and has a plurality of nozzles, and a droplet receiver positioned capable of receiving liquid ejected from the nozzles. The nozzles which eject a droplet of a second liquid is positioned, in a flushing region, farthest from a printing region compared to the other nozzles. The droplet ejection device is configured to move the carriage after flushing operation so that the nozzles for ejecting a droplet of the second liquid are brought to a position where the nozzles face a part of the droplet receiver where a droplet of the first liquid has been received.

7 Claims, 14 Drawing Sheets

DROPLET EJECTION DEVICE

The present application claims priority from Japanese Patent Application No. 2007-262903, which was filed on Oct. 9, 2007, the disclosure of which is herein incorporated by reference in its entirety.

BACKGROUND OF THE INVENTION

1. Field of the Invention

The present invention relates to a droplet ejection device which ejects droplets.

2. Description of Related Art

A known droplet ejection device which ejects droplets is an inkjet recording apparatus which records a letter or an image on a recording medium by ejecting from nozzles droplets of ink to a recording medium such as a recording sheet. Such an inkjet recording apparatus, in general, is provided with an inkjet head having a carriage capable of making a back-and-forth movement in a direction orthogonal to the conveyance direction of the recording sheet and nozzles formed on the carriage. The inkjet recording apparatus records text or an image on a recording sheet by ejecting ink from at least one of the nozzles on the inkjet head, while moving the carriage.

The inkjet head of the inkjet recording apparatus however has the following problem. Namely, when the inkjet head is left for a long time without performing recording: that is, the state of not ejecting ink from the nozzle lasts for a long time, the ink inside the nozzle dries, and may cause a clogging in the nozzle. Even if the printing is performed, an inkjet recording apparatus using more than one type of ink has a problem that there is a nozzle which frequently ejects ink and a nozzle which rarely ejects ink, depending on the type of ink. In the inkjet recording apparatus, new ink is successively supplied to the nozzle frequently ejecting ink and therefore clogging in such a nozzle hardly occurs. However, in the nozzle which rarely ejects ink, new ink is rarely supplied. Therefore, the ink in the nozzle more easily dries up, consequently causing a clogging in the nozzle.

To solve the above problem, a flushing operation is performed in some cases. Specifically, an ink receiver is provided outside a recording sheet conveyance path, and a carriage is moved so as to bring the inkjet head in a position where the inkjet head faces the ink receiver. Then, ink is ejected from each of the nozzles to the ink receiver, so as to discharge highly viscous ink inside the nozzle. The ink discharged through this flushing operation adheres to and is absorbed by an absorber provided to the ink receiver.

Note that a plurality of types of ink ejected to the ink receiver through the above flushing operation includes a type of ink which easily solidifies. When such an easily-solidifiable ink adheres to the ink receiver, a highly-vaporizable solvent in the ink vaporizes before the ink is absorbed into the absorber. As a result, the ink adheres and solidifies on the surface of the absorber. When ink droplets are further ejected from the nozzles in the subsequent flushing operation while the absorber has thereon solidified ink, the ejected ink further adheres and solidifies on the solidified ink. Repeating this deposits solidified ink on the absorber, thus forming a pile of solidified ink. This leads to a problem that the lower surface (nozzle) of the inkjet head contacts the deposition of the ink, when the inkjet head moves along with the carriage to perform the flushing operation.

To solve this, Japanese Unexamined Patent Publication No. 168177/2006 (Tokukai 2006-168177) discloses a droplet ejection device in which low viscous ink which hardly thickens (hardly solidifiable ink) is landed on highly viscous ink which easily thickens (easily solidifiable ink) and which adhered on the ink receiver at the time of flushing operation, thereby dissolving the ink adhered on the ink receiver.

However, in the droplet ejection device of the above publication, nozzles (N7 in the publication) which eject hardly solidifiable ink for dissolving the adhered ink are closer to a printing region in the moving direction of the carriage, compared to nozzles (N4 and N5 in the publication) which eject easily solidifiable ink. To dissolve the deposition of easily solidifiable ink adhered on the surface of the ink receiver, the carriage needs to be further moved from the flushing region, towards a direction opposite to the printing region (towards outside of the apparatus), so that the nozzles (N7) for ejecting the hardly-solidifiable ink are outside the ink receiver (left end in FIG. 1 of the publication). This causes an increase in the size of the apparatus.

SUMMARY OF THE INVENTION

An object of the present invention is to provide a droplet ejection device which is capable of dissolving ink received by a droplet receiver, while avoiding an increase in the size of movement range of the carriage, and while allowing downsizing of the apparatus.

A droplet ejection device of the present invention includes: a carriage, a droplet ejection head, a control unit, and a droplet receiver. The carriage is capable of moving back and forth in a predetermined direction. The droplet ejection head is mounted on the carriage and has plural nozzles arranged in the predetermined direction which nozzles eject plural types of liquids in the form of droplets. The control unit is configured to move the carriage in the predetermined direction, and to cause the droplet ejection head to perform an ordinary ejection operation and a flushing operation, wherein (i) the ordinary ejection operation is an operation of ejecting a droplet from at least one of the nozzles, in an ordinary ejection region within a moveable range of the carriage, and (ii) the flushing operation is an operation of ejecting a droplet from at least one of the nozzles in a flushing region outside the ordinary ejection region. The droplet receiver is positioned in the flushing region, which receives a droplet ejected from at least one of the nozzles during the flushing operation. The plural types of liquids ejected in the form of droplets are distinguishable into two or more ranks in terms of how easily solidification occurs after adhering to the droplet receiver. The plural nozzles includes a first nozzle which ejects a droplet of the first liquid and a second nozzle which ejects a droplet of the second liquid which is less solidifiable than the first liquid. The control unit, during the flushing operation, is configured to cause the droplet ejection head to eject a droplet of the first liquid from the first nozzle, cause the carriage to move in the predetermined direction so that a droplet to be ejected from the second nozzle drops onto a part of the droplet receiver having received the droplet from the first nozzle, and then cause the droplet ejection head to eject a droplet of the second liquid from the second nozzle. Among the plural nozzles, the second nozzle is positioned farthest from the ordinary ejection region in the predetermined direction while the droplet ejection head is in the flushing region.

According to the droplet ejection device of the present invention, when the droplet ejection head is in the flushing region, the second nozzle which ejects a droplet of the second liquid less solidifiable than the first liquid is positioned furthest from the ordinary ejection region in the predetermined direction, and one or more nozzles other than the second nozzle are positioned closer to the ordinary ejection region than the second nozzle. Therefore, moving the carriage toward the ordinary ejection region allows a droplet of the second liquid ejected from the second nozzle to drop onto the first liquid having been ejected from the first nozzle and received by the droplet receiver. Therefore, it is possible to dissolve the first liquid which has already been received by the droplet receiver using the second liquid ejected from the second nozzle. The moving direction of the carriage for dissolving the first liquid is a direction approaching the ordinary ejection region, rather than a direction departing from the ordinary region. This enables downsizing of the droplet ejection device in relation to the predetermined direction.

BRIEF DESCRIPTION OF THE DRAWINGS

Other and further objects, features and advantages of the invention will appear more fully from the following description taken in connection with the accompanying drawings in which:

FIG. 14 illustrates an alternative form of the series of operations to solve Black ink on the first absorber

DESCRIPTION OF THE PREFERRED EMBODIMENTS

The following describes a best mode for carrying out the invention, with reference to attached drawings. The present embodiment deals with an application of the present invention to an inkjet printer capable of recording (printing) an intended image or text on a recording sheet, by ejecting ink from the inkjet head to the recording sheet. The inkjet printer of the present invention is applicable not only to an individual printing apparatus, but also to a printer of an MFD (Multi Function Device) capable of functioning as a copy machine, scanner, facsimile, and the like.

Figure 1:
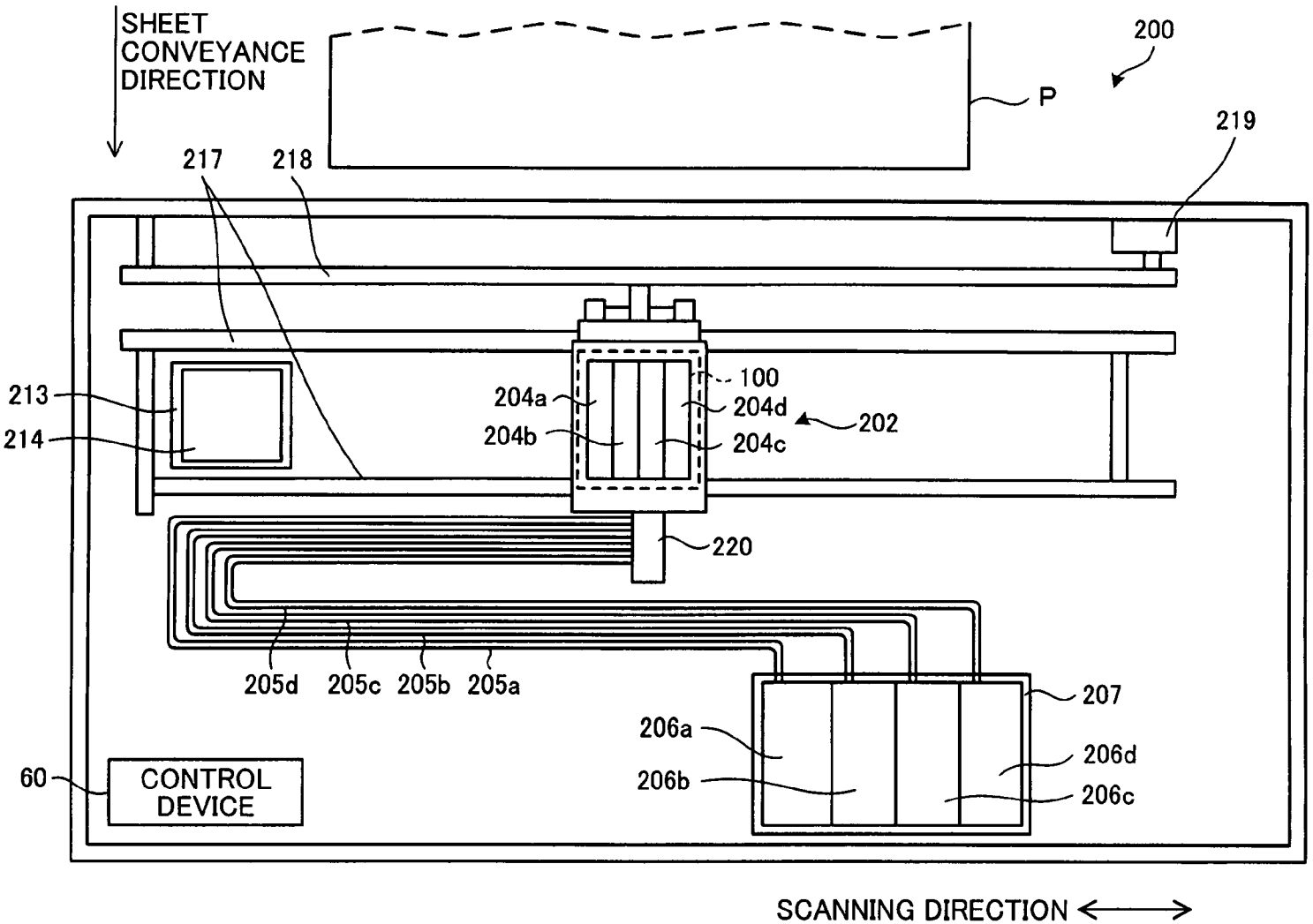
FIG. 1 is a plan view illustrating a schematic configuration of an inkjet printer of an embodiment.

FIG. 1 is a plan view illustrating a schematic structure of an inkjet printer of the present invention. As illustrated in FIG. 1, the inkjet printer 200 includes: a carriage 202 which is capable of moving back and forth in a single direction; an inkjet head 100 mounted to the carriage 202, which serves as a droplet ejecting head; four sub tanks 204*a* to 204*d*; four ink cartridges 206*a* to 206*d* for storing ink; and a receiving tray 213 serving as a droplet receiver, which receives ink droplet ejected from later-mentioned nozzles 4 of the inkjet head 100, at a time of performing the flushing operation.

The carriage 202 is attached to and spans two guide shafts 217 extending parallel to each other in right/left direction of FIG. 1, and is capable of moving back and forth along guide shafts 217. Further, the carriage 202 is coupled with a continuous belt 218. When this continuous belt 218 is driven and run by the carriage drive motor 219, the carriage 202 moves towards left or right according to the running of the continuous belt 218.

Figure 3:
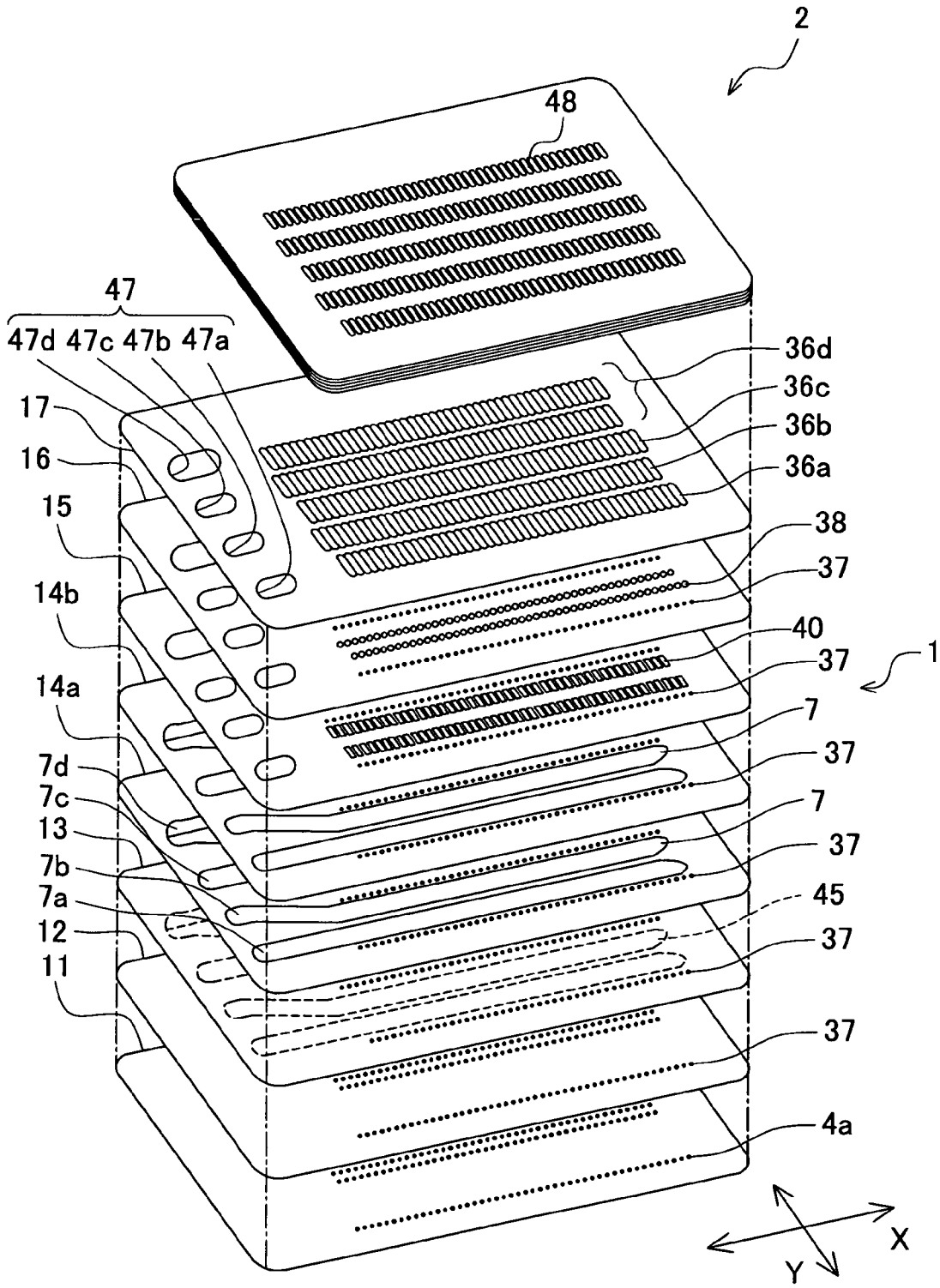
FIG. 3 is a perspective diagram providing an exploded view of a passage unit.

To the carriage 202, the inkjet head 100 and four sub tanks 204*a* to 204*d* are mounted. The inkjet head 100 ejects ink from a plurality of nozzles 4 toward a recording sheet P, while moving back and forth in a scanning direction with the carriage 202. Specifically, from the nozzles 4 of FIG. 3 provided on the lower surface (a surface of FIG. 7 farther from the viewer), ink is ejected to the recording sheet P which is conveyed downward in FIG. 1 (in a direction orthogonal to the scanning direction) by a not-illustrated conveyance motor 220 of sheet conveyance mechanism illustrated in FIG. 7. Thus, an intended image or text is recorded on the recording sheet P.

The four sub tanks 204*a* to 204*d* are positioned in the scanning direction (Y-direction). For example, inks of four colors: Yellow, Cyan, Magenta, and Black, are respectively stored in these four sub tanks 204*a* to 204*d* in this order from the left of FIG. 1. Further, the four sub tanks 204*a* to 204*d* are integrally provided with a tube joint 220. The four sub tanks 204*a* to 204*d* are connected to the four ink cartridges 206*a* to 206*d*, via flexible tubes 205*a* to 205*d* coupled with the tube joint 220, respectively.

To the ink cartridges 206*a* to 206*d*, inks of four colors: Yellow, Cyan, Magenta, and Black are stored respectively. These ink cartridges 206*a* to 206*d* are detachably attached to a holder 207 placed on a inkjet printer main body.

The inks of four colors in the four ink cartridges 206*a* to 206*d* are temporarily stored in the four sub tanks 204*a* to 204*d* respectively, and are supplied to the inkjet head 100 thereafter.

Figure 8:
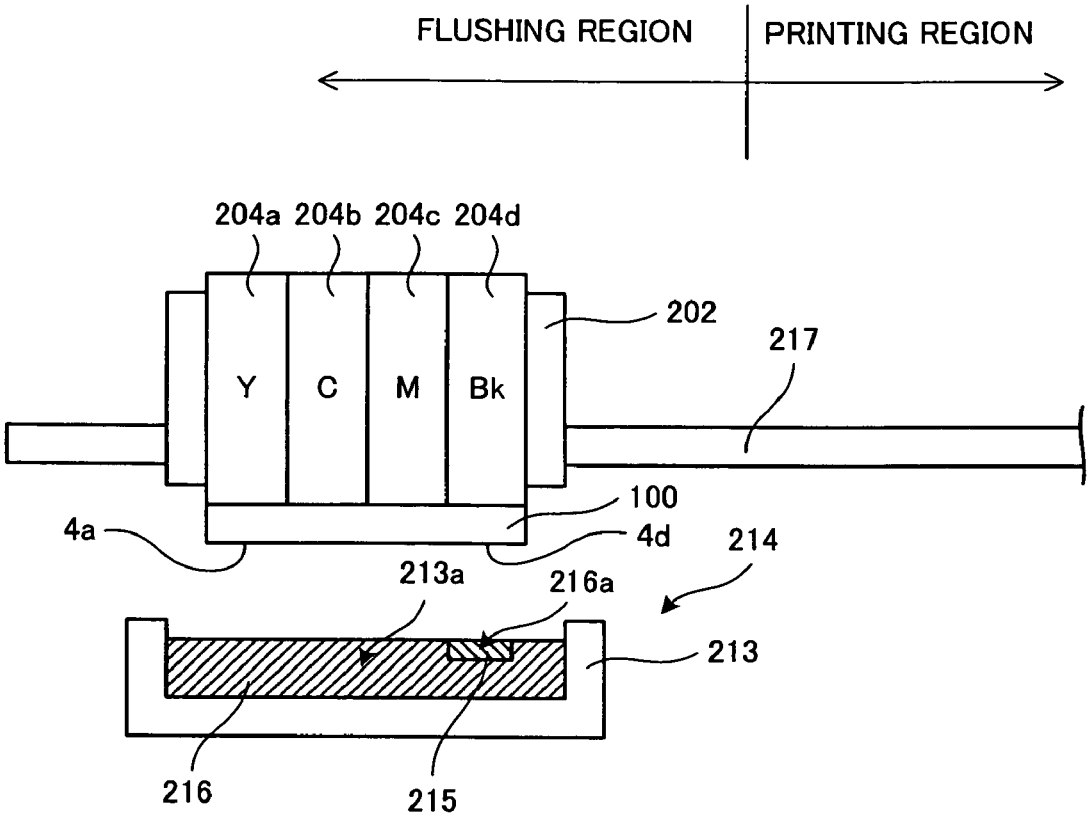
FIG. 8 is a front view of a flushing region in the flushing operation.

The receiving tray 213 is within the moveable range of the carriage 202 in the scanning direction, and is positioned in a region (hereinafter, flushing region) outside the printing region where the inkjet head 100 faces the recording sheet P, as illustrated in FIG. 8. In other words, the receiving tray 213 is positioned in the flushing region which is on the left of an ejection region in FIG. 1. The receiving tray 213 has a rectangular parallelepiped shape, and has a rectangular recess 213*s* which is open upwardly. When viewing the recess 213*a* from the above (when viewing FIG. 1 orthogonally to the page), the recess 213*a* has a rectangular shape with a larger projected area than that of the droplet ejection surface having the nozzles 4. In the recess 213*a* is arranged an absorber 214 which is made of a porous member such as sponge or non-woven fabric. When the carriage 202 moves to the flushing region during a later-mentioned flushing operation, the absorber 214 faces the lower surface of the inkjet head 100 (the droplet ejection surface having the nozzles 4). The absorber 214 then absorbs ink droplets ejected from the nozzles 4.

Figure 2:
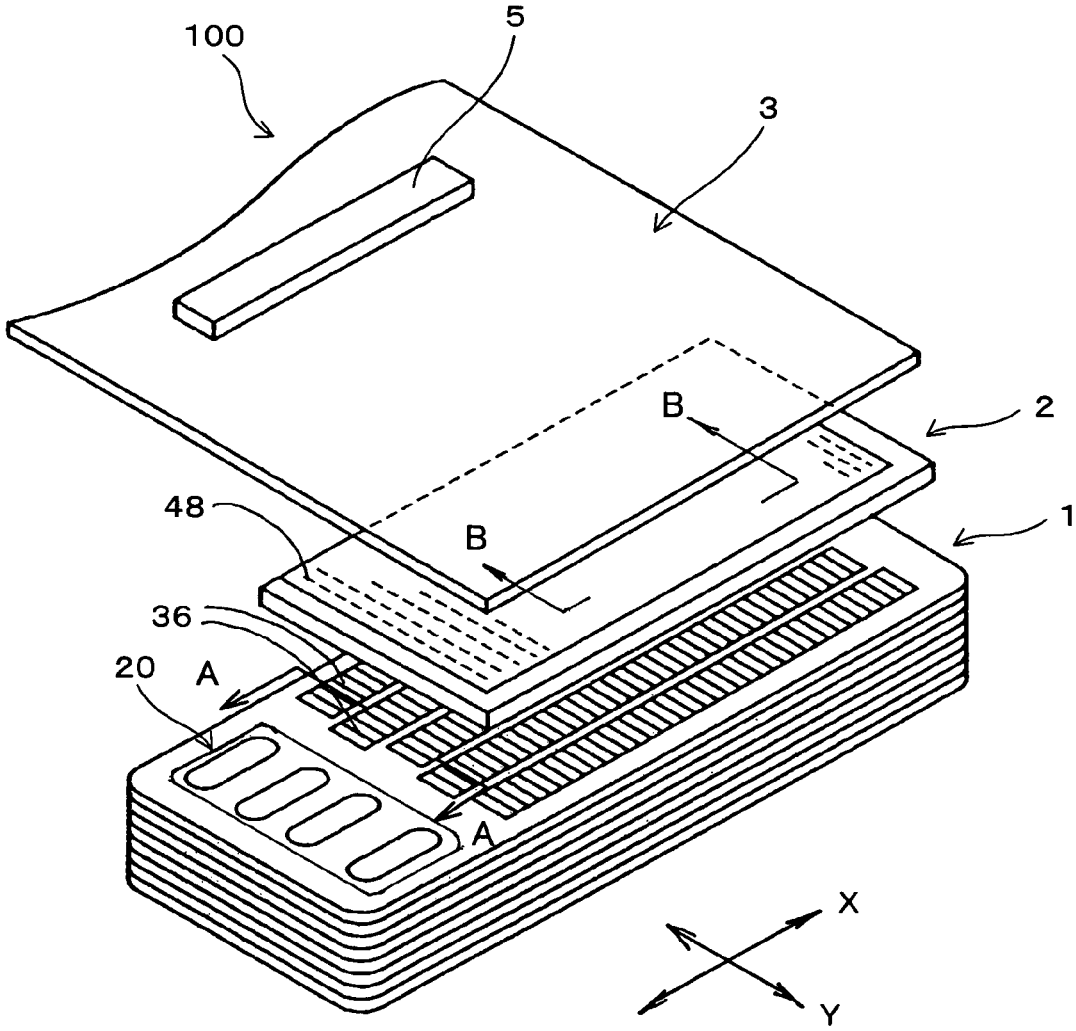
FIG. 2 is a perspective diagram of an inkjet head.

Next, the inkjet head 100 is described. FIG. 2 is a perspective diagram of the inkjet head.

As illustrated in FIG. 2, the inkjet head 100 is structured by coupling a plate-type piezoelectric actuator 2 with the top surface of a passage unit 1 made of a plurality of plates. The top surface of the plate-type piezoelectric actuator 2 is coupled with a flexible flat cable 3 which provides an electrical connection with an external device. On the top surface of the flexible flat cable 3 is connected a driver IC 5 which serves as a drive circuit. Further, the inkjet head 100 ejects ink downward from the nozzles 4 formed on the lower surface of the passage unit 1, as is illustrated in FIG. 3.

Figure 4:
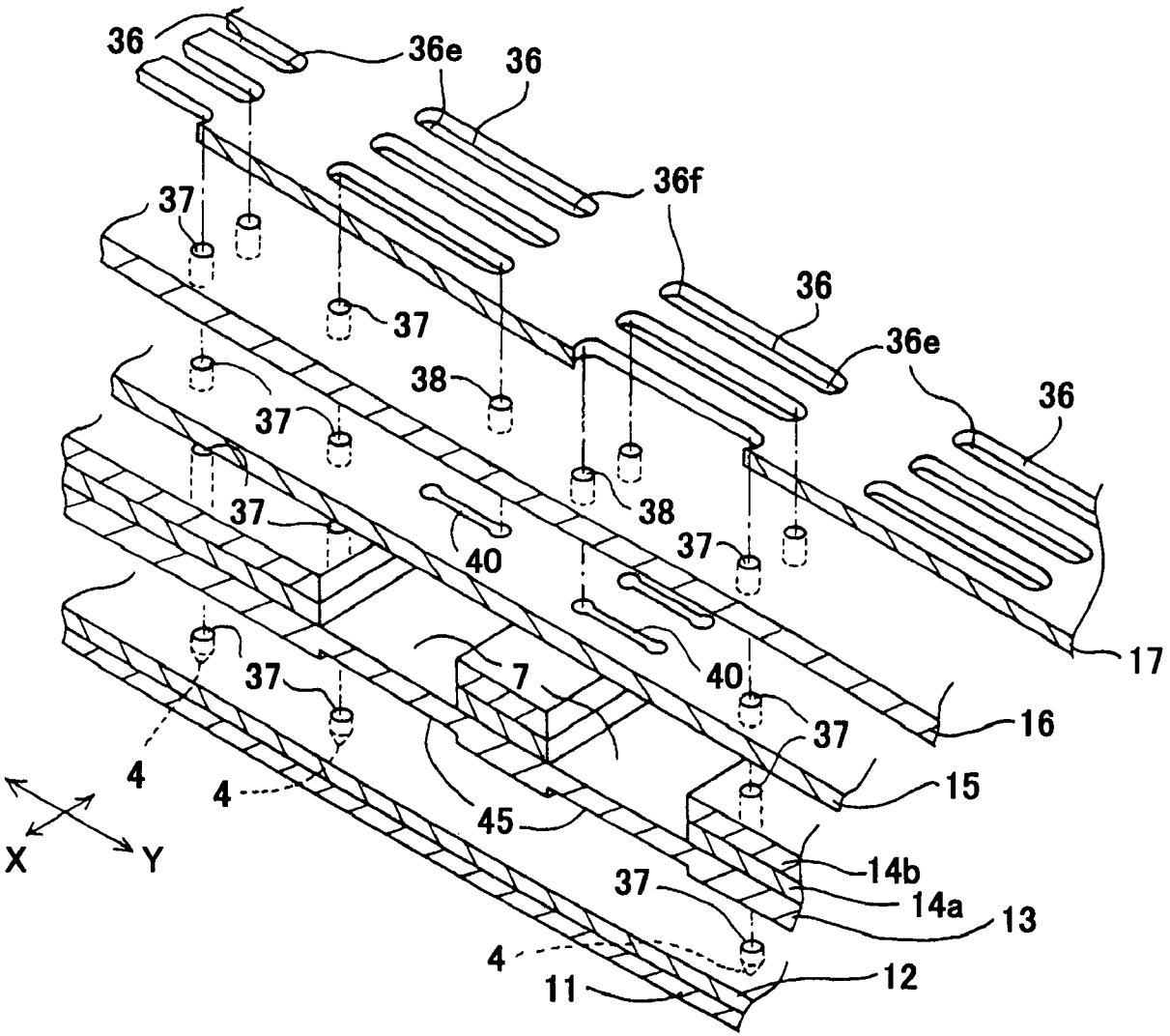
FIG. 4 is a perspective diagram providing an enlarged exploded view of the passage unit.
Figure 5:
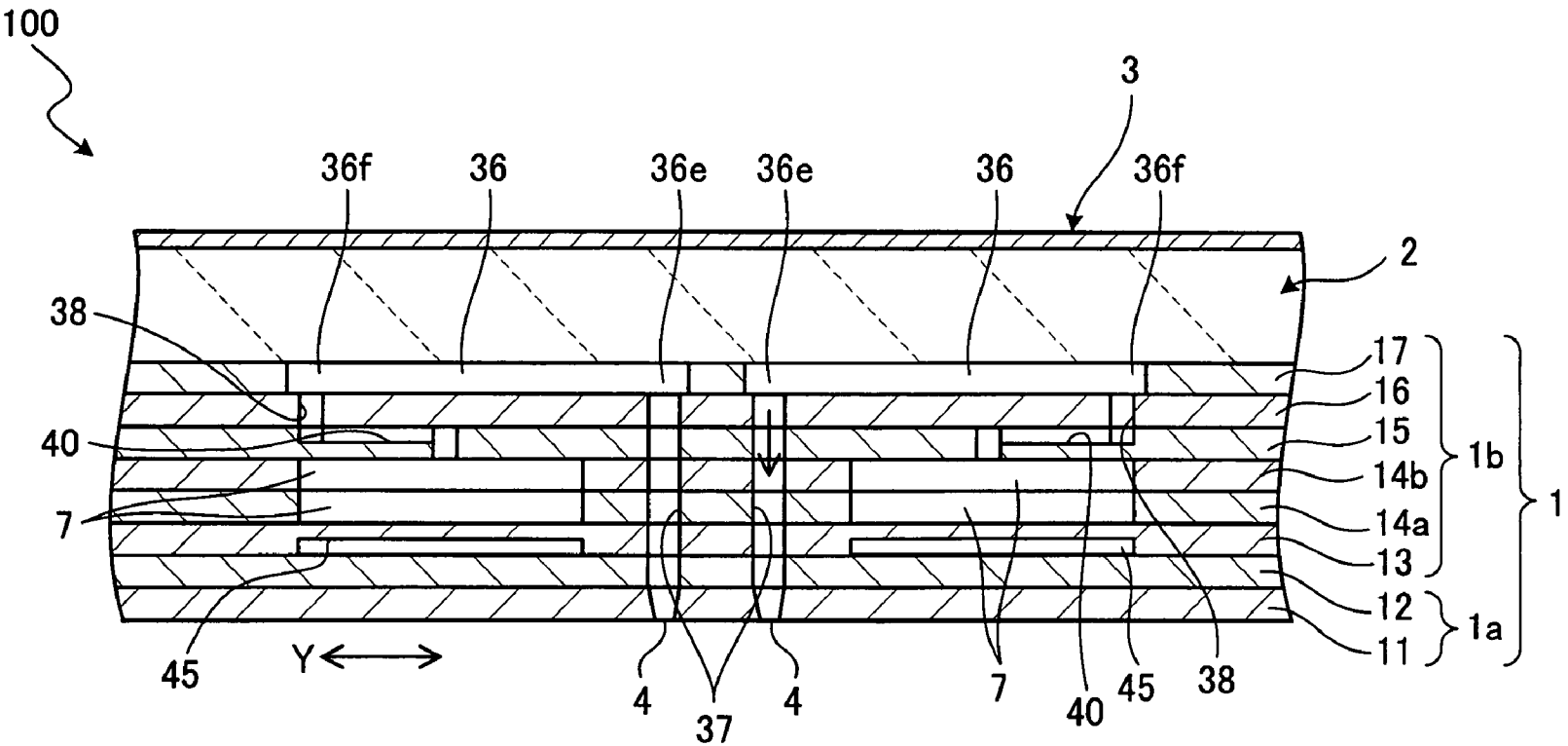
FIG. 5 is a cross sectional view taken along line A-A of FIG. 2.

Next, the following describes the passage unit 1 with reference to FIG. 3 to FIG. 5. FIG. 3 is a perspective diagram providing an exploded view of the passage unit. FIG. 4 is a perspective diagram providing an enlarged exploded view of the passage unit. FIG. 5 is a cross sectional view taken along the line A-A of FIG. 2. As illustrated in FIG. 3, the passage unit 1 is structured by laminating and bonding a total of eight thin plates. These eight plates are: a nozzle plate 11, a spacer plate 12, a dumper plate 13, two manifold plates 14*a* and 14*b*, a supply plate 15, a base plate 16, and a cavity plate 17 sequentially from the lower most layer. Except for the nozzle plate 11 made of a synthesized resin such as polyimide, each of the plates 12 to 17 is made of a 42% nickel steel alloy plate which is approximately 50 to 150 μm in thickness.

The nozzle plate 11 has the nozzles 4 of 20 μm in nozzle diameter, which eject droplets having a minute diameter. The nozzles 4 are formed at a minute pitch in a longitudinal direction of nozzle plate 11 (X direction). These nozzles 4 are aligned in five rows in the longitudinal direction (X direction). Each row is suitably spaced from and aligned parallel to an adjacent row. That is, these nozzles 4 are lined up to form rows of Yellow ink, Cyan ink, Magenta ink, and Black ink, which rows extend in X direction and are aligned in Y direction. These rows are arranged in the order above. That is, in FIG. 3, the row of Yellow ink is the closest to the viewer. Note that nozzles 4 for ejecting Yellow ink is hereinafter referred to as nozzles 4*a*, and nozzles 4 for ejecting Black ink is hereinafter referred to as nozzles 4*d*. Note further that, although clear indication is not provided, there are two rows of nozzles 4*d* which eject Black ink.

As illustrated in FIG. 4, the cavity plate 17 has five rows of pressure chambers 36*a* to 36*d*. These rows respectively correspond to the rows of nozzles 4 for Yellow, Cyan, Magenta, and Black, and are aligned in this order. That is, in FIG. 4, the row of pressure chambers 36*a* to 36*d* corresponding to the row of nozzles 4 for Yellow is the closest to the viewer. Each pressure chamber 36 penetrates the thickness of the cavity plate 17, and is formed in a rectangular shape in plane view. The longitudinal direction of the pressure chamber 36 corresponds to the direction (Y-direction) orthogonal to the direction in which rows of nozzles 4 extend. Note that there are two rows of pressure chambers 36 associated with Black ink.

The leading end 36*e* of each pressure chamber 36 is in communication with a nozzle 4 on the nozzle plate 11, via continuous holes 37 formed on the base plate 16, supply plate 15, two manifold plates 14*a* and 14*b*, the dumper plate 13, and the spacer plate 12.

The base plate adjacent to the lower surface of the cavity plate 17 has a continuous hole 38 which connects to one end 36*f* of the pressure chamber 36. The supply plate 15 adjacent to the lower surface of the base plate 16 has connection passage 40 for supplying ink from later-mentioned common ink chambers 7 to the pressure chamber 36. This connection passage 40 includes: an input port to which ink is input from the common ink chambers 7; an exit port which opens so as to face the continuous hole 38; and a draw portion formed with a small cross section area so as to achieve a highest passage resistance within the connection passage 40.

Two manifold plates 14*a* and 14*b* have five common ink chambers 7*a* to 7*d* which penetrate through the both manifold plates 14*a* and 14*b* in the thickness direction. These common ink chambers 7*a* to 7*d* respectively correspond to rows of the pressure chambers 36*a* to 36*d* which are long in the direction in which the rows of the pressure chambers 36*a* to 36*d* extend. That is, as illustrated in FIG. 3 and FIG. 5, these five common ink chambers 7*a* to 7*d* are formed by laminating the two manifold plates 14*a* and 14*b*, covering the top of the lamination with the supply plate 15, and covering the bottom of the lamination with the dumper plate 13.

As illustrated in FIG. 4 and FIG. 5, the dumper plate 13 adjacent to the lower surface of the manifold plate 14*a* has, on its lower surface, recesses serving as dumper chambers 45 which are isolated from the common ink chambers 7. The position and the shape of each dumper chamber 45 formed is the same as those of the common ink chambers 7. A thin ceiling part at the top of each dumper chamber 45 elastic-deforms and vibrates so as to yield a dumper effect whereby pressure variation taking place in the pressure chamber 36 during ink ejection is absorbed and attenuated.

Further, as illustrated in FIG. 3, at one ends of the cavity plate 17, base plate 16, and supply plate 15 in the longitudinal direction, four ink supply ports 47*a* to 47*d* are formed so that these ports on any of the plates matches with those on another one of the plates. Through these ink supply ports 47*a* to 47*d*, ink supplied from the ink cartridges 206*a* to 206*d* via the tubes 205*a* to 205*d* and tube joint 220 is supplied to one ends of the common ink chambers 7*a* to 7*d* in the longitudinal direction, respectively.

The ink supplied to the common ink chamber 7*a* to 7*d* is distributed to the pressure chambers 36*a* to 36*d* via connection passage 40 of the supply plate 15 and the through holes 38 of the base plate 16, as illustrated in FIG. 5. Then, as hereinafter mentioned, driving of a drive unit 49 of the piezoelectric actuator 2 feeds the ink from the pressure chamber 36 to each of the associated nozzles 4 via the continuous holes 37.

Note that, as illustrated in FIG. 3, the number of ink supply ports 47*a* to 47*d* is four while the numbers of common ink chambers 7, nozzles 4, and pressure chambers 36 are all five, in this embodiment. Only the leftmost ink supply ports 47*d* in FIG. 3 is structured to supply ink to two common ink chambers 7*d*. This is because the ink supply port 47*d* is designed for supplying thereto Black ink which is most frequently used compared to ink of other colors. Accordingly, Black ink supplied to the two common ink chambers 7*d* is ejected from two rows of nozzles 4*d* via two rows of pressure chambers 36*d*. Further, the inks of Yellow, Cyan, and Magenta are supplied to the other ink supply ports 47*a* to 47*c*, respectively. The inks supplied are ejected from the nozzles 4, via the associated common ink chambers 7 and pressure chambers 36. On top of the passage unit 1, a filter 20 is adhered via an adhesive agent or the like, as illustrated in FIG. 2.

Figure 6:
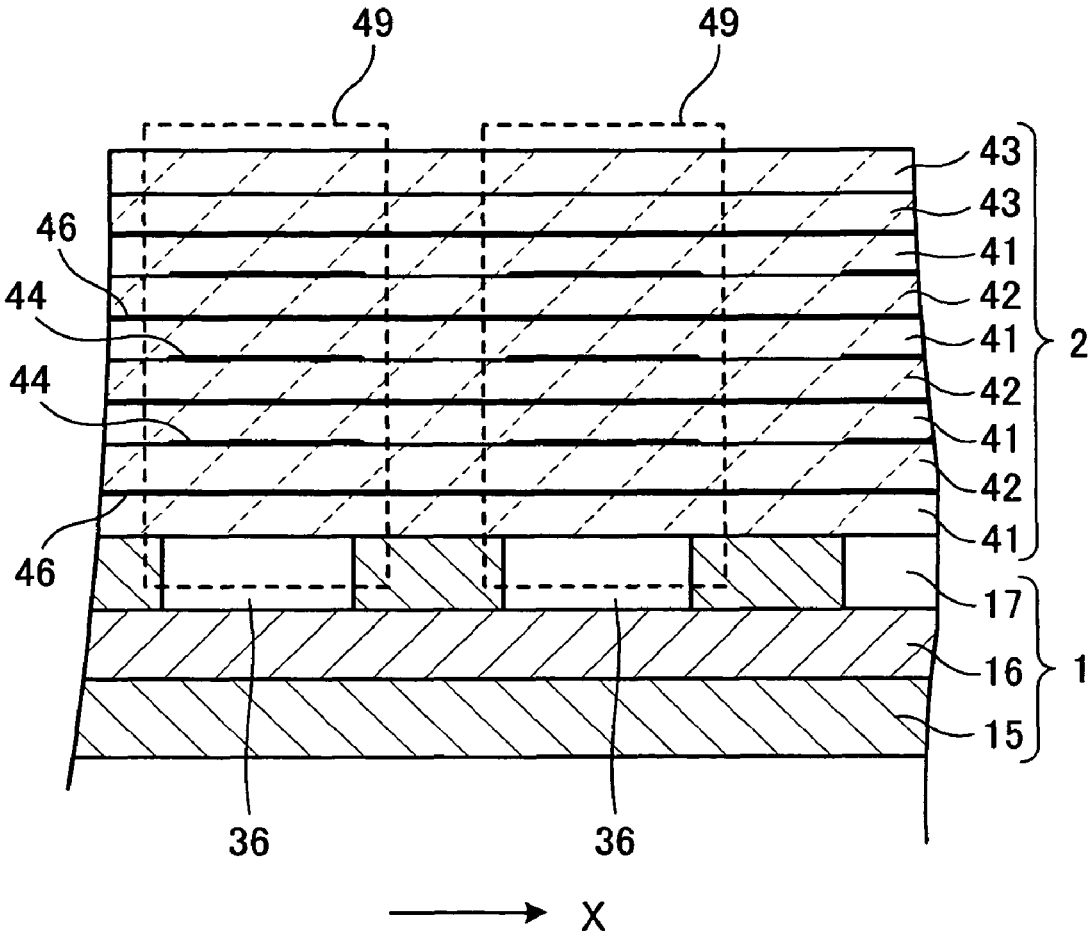
FIG. 6 is a cross sectional view taken along line B-B of FIG. 2.

Next, the piezoelectric actuator 2 is described. FIG. 6 is a cross sectional view taken along the line B-B of FIG. 2. As illustrated in FIG. 6, the piezoelectric actuator 2 is a lamination of a total of nine piezoelectric sheets 41 to 43 each having the thickness of approximately 30 μm. More specifically, from the lowermost layer of the piezoelectric actuator 2, the piezoelectric sheets 41 and 42 are alternately laminated to form a total of seven layers. Above these seven layers are laminated two piezoelectric sheets 43. Counting from the bottom, an even-number-th boundary between the piezoelectric sheets 41 and 42 has narrow individual electrodes 44 which are respectively positioned to face the pressure chambers 36 in the passage unit 1. On the other hand, an odd-number-th interface between the piezoelectric sheets 41 and 42 has a common electrode 46 for a plurality of pressure chambers 36.

As illustrated in FIG. 3, more than one surface electrodes 48 are formed on the top surface of the upper most sheet which surface is also the top surface of the piezoelectric actuator 2 (a surface opposite of the passage unit 1). These surface electrodes 48 are electrically connected to the individual electrodes 44 and the common electrode 46 via through holes. Further, these surface electrodes 48 are electrically connected to the later-mentioned driver IC 5 on the flexible flat cable 3 illustrated in FIG. 2. The common electrode 46 is electrically connected to a ground (GND). A drive voltage supplied from the driver IC 5 to the individual electrodes 44 forms a single drive unit 49 whereby a pressure is selectively applied to a pressure chamber 36 from portions of the piezoelectric sheets 41 and 42 between the individual electrodes 44 and common electrodes 46 facing that pressure chamber 36.

Except for the lowermost piezoelectric sheet 41, the direction of polarization of the piezoelectric sheets 41 and 42 in the drive unit 49 is the direction of the thickness thereof. When a voltage is applied between the individual electrodes 44 and the common electrodes 46, an electric field is generated in the piezoelectric sheets 41 and 42. The direction of the electric field is the same as the direction of the polarization of the piezoelectric sheets 41 and 42. The electric field generated causes the piezoelectric sheets 41 and 42 between the electrodes 44 and 46 to serve as active layers and expand in the direction of the polarization (in the up/down direction) due to a longitudinal piezoelectric field effect. The expansion of the piezoelectric sheets 41 and 42 between the electrodes 44 and 46 reduces the volume of the pressure chamber 36, applying a pressure to the ink inside the pressure chamber 36. As a result, ink is ejected from the nozzles 4.

Figure 7:
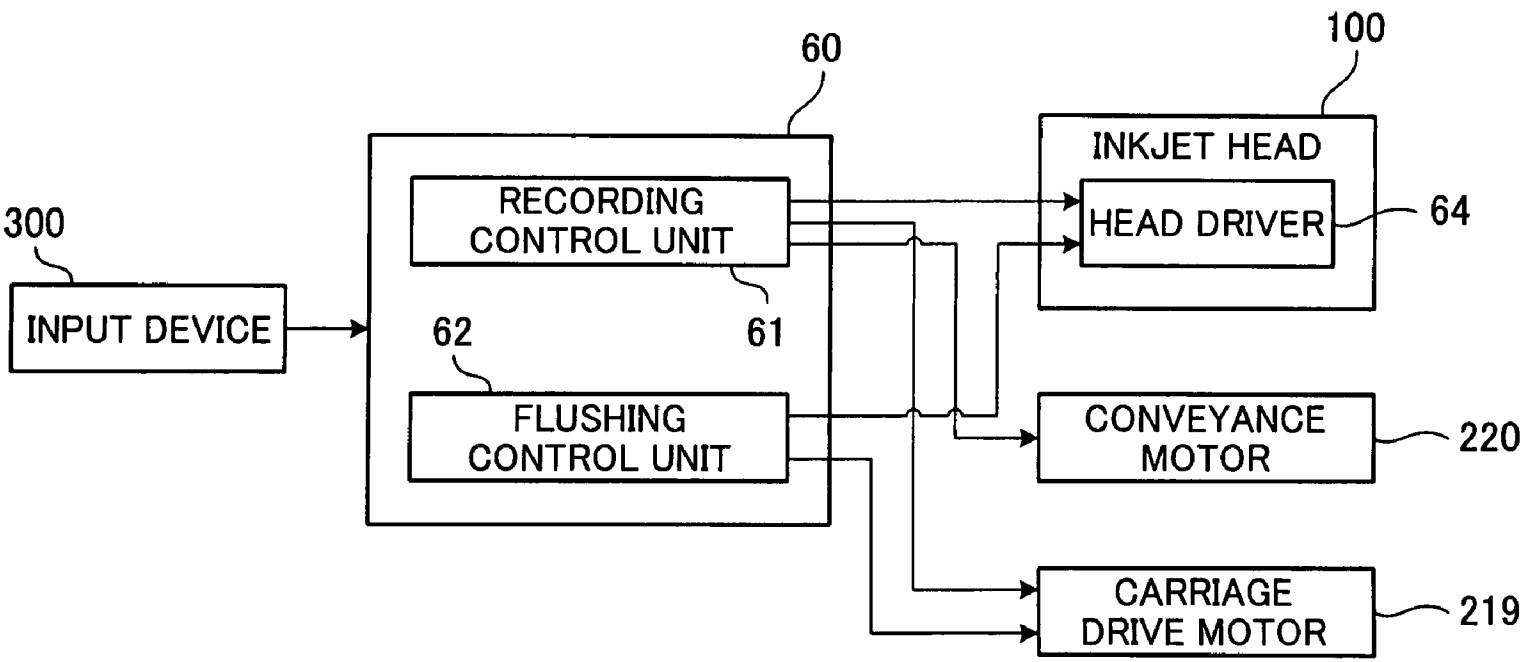
FIG. 7 is a block diagram illustrating an electrical structure of the inkjet printer.

Next described is a control device 60 which controls the entire inkjet printer 200. FIG. 7 is a block diagram illustrating an electrical structure of the inkjet printer. The control device 60 illustrated in FIG. 7 includes: a CPU (Central Processing Unit); a ROM (Read Only Memory) storing therein various programs and data for controlling the entire operation of the inkjet printer 200; a RAM (Random Access Memory) for temporarily storing data to be processed by the CPU; or the like.

Further, the control device 60 includes a recording control unit 61 and a flushing control unit 62.

Based on data input via an input device 300 of a PC or the like, the recording control unit 61 controls: the carriage drive motor 219 which drives a back-and-force movement of the carriage 202 illustrated in FIG. 1; the head driver 64 of the inkjet head 100; the conveyance motor 220 in a not-illustrated sheet conveyance mechanism which conveys a recording sheet P; or the like, thus performing a recording operation (ordinary ejection operation) of an image or the like on a recording sheet P by ejecting ink from the nozzles 4 in the printing region.

The flushing control unit 62 controls the carriage drive motor 219, the head driver 64 (driver IC 5), or the like, so as to perform a flushing operation in the flushing region outside the printing region, in which operation ink is ejected from the nozzles 4 towards the absorber 214 positioned inside the receiving tray 213. Note that the flushing operation encompasses: a pre-recording flushing to be performed prior to a recording operation, a periodic flushing to be performed upon elapse of a certain period from the previous flushing, a flushing operation performed as intended by a user, or the like. This is hereinafter detailed.

The following describes the flushing operation performed by the flushing control unit 62. When ejection of ink from the nozzles 4 is not performed for a long period of time, the solvent of the ink dries, and the viscosity of the ink inside the nozzles 4 of the inkjet head 100 increases. That is, the ink inside the nozzles 4 of the inkjet head 100 is thickened. The thickening of the ink may cause defective ejection, in an occasion of ejecting droplets from the nozzles 4 for the purpose of recording an image on a recording sheet P.

In view of that, the flushing operation is performed during or prior to the recording operation, so as to discharge thickened inks inside the nozzles 4 by ejecting the thickened inks from the nozzles 4 through the flushing operation. Specifically, when a flushing command is output to the flushing control unit 62, the inkjet printer 200 causes the flushing control unit 62 to drive the carriage drive motor 219, thereby moving the carriage 202 to the left of FIG. 1 and positioning the inkjet head 100 to face the receiving tray 213. Then, all the nozzles 4, except for those which eject Yellow ink, eject inks all at once towards the absorber 214 positioned in the receiving tray 213, thereby discharging the thickened inks inside these nozzles 4. The thickened inks of Cyan, Magenta, and Black discharged from the nozzles 4 adhere to the surface of the absorber 214 sequentially in this order from the left of FIG. 1, and are absorbed inside the absorber 214 with elapse of time. The inks absorbed inside the absorber 214 is fed to a not-illustrated waste liquid tank connected to the lower surface of the receiving tray 213.

Suppose that the degree of how easily ink solidifies (hereinafter, solidifiability) is different depending on the types of ink. More solidifiable ink adheres to the absorber 214 during the flushing operation, and then solidifies on the surface of the absorber 214 before the ink is absorbed inside the absorber 214. When another flushing operation is performed while the ink is solidified on the absorber 214, solidified ink adheres on the already-solidified ink. Repeating this process will form a pile of solidified ink on the absorber 214.

In the present embodiment, pigment ink is used for Black ink and dye ink for other inks of other colors; that is, Yellow, Cyan, and Magenta. The pigment ink is ink whose solvent contains a pigment component. This pigment component is insoluble in a surfactant or water, and is dispersed in the solvent of ink in a granular form. When this pigment ink is ejected from the nozzles 4 to the recording sheet P, the particles of the pigment component remain on the recording sheet P and develop a color on their own. The dye ink, on the other hand, is ink whose solvent contains a dye component which is dissolved in the solvent. When the dye ink is ejected from the nozzles 4 to a recording sheet P, the solvent in which the dye component is dissolved infiltrates into the recording sheet P, thereby developing a color. Typically, the solvent of pigment ink is highly volatile, and as such, pigment ink solidifies more easily than dye ink.

Table 1 presents the solidifiability indexes of each ink type. Each index adopts Black ink (Bk) as the norm, and is calculated out from a complete evaporation viscosity. The complete evaporation viscosity is a viscosity of ink remaining after evaporation of its components such as water, volatile surfactant, or the like, excluding involatile components such as pigment/dye component. This complete evaporation viscosity is calculated out for each ink type, and each index is derived by multiplying the complete evaporation viscosity by a coefficient so that Black ink is 1. An increase in the value of the index represents an increase in the solidifiability of the ink.

TABLE 1

| | INDEX |
|---|---|
| Y | 0.15 |
| C | 0.34 |
| M | 0.3 |
| Bk | 1 |

Bk IS ADOPTED AS THE NORM (Bk IS 1)

Black ink (first liquid) is the most solidifiable ink, and Yellow ink (second liquid) is the least solidifiable ink. The solidifiability of each ink type therefore increases in the following order: Black ink (Bk)>Cyan ink (C)>Magenta ink (M)>Yellow ink (Y). Thus, after ink droplets are ejected from the nozzles at once and adheres to the absorber 214 during the flushing operation, droplets of Black ink adheres to the surface of the absorber 214 and solidifies thereon before being absorbed inside the absorber 214. Thus, droplets of Black ink piles up. Note that the present embodiment deals with a case where the solidifiability is different among inks. However, the present invention is not limited to this provided that the solidifiability of each ink is distinguishable into at least two ranks of solidifiability: easily solidifiable and hardly solidifiable.

To enable the absorber 214 to absorb Black ink adhered thereto, the inkjet printer 200, after the flushing operation, moves the carriage 202 so that the nozzles 4*a* for ejecting Yellow ink (the least solidifiable ink) are brought to a position where the nozzles 4*a* face a part of the absorber 214 where Black ink has adhered. When droplets of Yellow ink (the least solidifiable ink) is ejected to the part of the absorber 214 where Black ink has adhered, Yellow ink lands on Black ink and dissolves the deposition of Black ink. By dissolving Black ink (the most solidifiable ink) on the absorber 214 with Yellow ink (hardly-solidifiable ink), the ink having dissolved by Yellow ink becomes less solidifiable than Black ink alone, and therefore is more easily absorbed into the absorber 214. That is, the flushing operation includes a series of operations ranging from an operation of ejecting ink from each nozzles 4 to an operation of ejecting Yellow ink from the nozzles 4*a* to dissolve Black ink.

The inkjet printer 200 of the present invention moves the carriage 202 towards the printing region by a predetermined distance so as to enable ejection of the least solidifiable ink (Yellow ink) to a part of the absorber 214 where the most solidifiable ink (Black ink) has been ejected. The inkjet printer 200 then ejects droplets of Yellow ink from the nozzles 4*a* towards Black ink adhered to the absorber 214.

As illustrated in FIG. 8, while the inkjet head 100 is in the flushing region, the nozzles 4*a* are most distanced from the printing region in the scanning direction in which nozzles 4 for a plurality of colors are aligned, the nozzles 4*a* serving as second nozzles for ejecting Yellow ink (the least solidifiable ink), for dissolving Black ink solidified on the absorber 214 after the flushing operation. That is, nozzles 4 for inks of Black and the others, which inks are more solidifiable than Yellow ink, are located closer to the printing region than the nozzles 4*a* for Yellow ink (the least solidifiable ink). As such, when dissolving Black ink (the most solidifiable ink), the carriage 202 moves in a direction approaching the printing region, rather than a direction departing from the printing region. This enables downsizing of the inkjet printer 200 relative to the moving direction (the scanning direction) of the carriage 202.

Further, Black ink deposited on the absorber 214 through the flushing operation forms a pile of Black ink. This leaves an extremely small area for landing droplets of Yellow ink which is ejected from the nozzles 4*a* for the dissolving purpose after the flushing operation. Therefore, landing the droplets of Yellow ink has been difficult and the shape of the pile has caused insufficient dissolution in some cases, partially leaving some remnant of undissolved ink. For this reason, a larger amount of Yellow ink needs to be landed to sufficiently dissolve the pile of Black ink. This may consequently increase the consumption of Yellow ink.

Considering that deposition is attributed to a highly solidifiable ink, a conceivable approach to reduce the deposition remaining on the absorber is to adopt a porous absorber such as sponge having a large absorbency. Typically, the absorbency of a porous absorber is higher with a higher hole percentage (percentage of the volume of holes in the absorber), irrespective of the hole diameter. Therefore, "hole diameter×hole percentage" may be either: "a small diameter×a higher percentage", or "a larger diameter×a lower percentage". However, an absorber having a large number of holes with a small diameter typically requires a high production costs, and therefore is not preferable. On the other hand, when adopting an absorber having a small number of holes with a large hole diameter, the capillary force for maintaining the ink absorbed in the absorber is weak because of the large hole diameter. Therefore, although such an absorber is able to absorb a large amount of ink, the absorber is not able to maintain the ink absorbed therein and may cause a problem such as an ink leakage.

Figure 9:
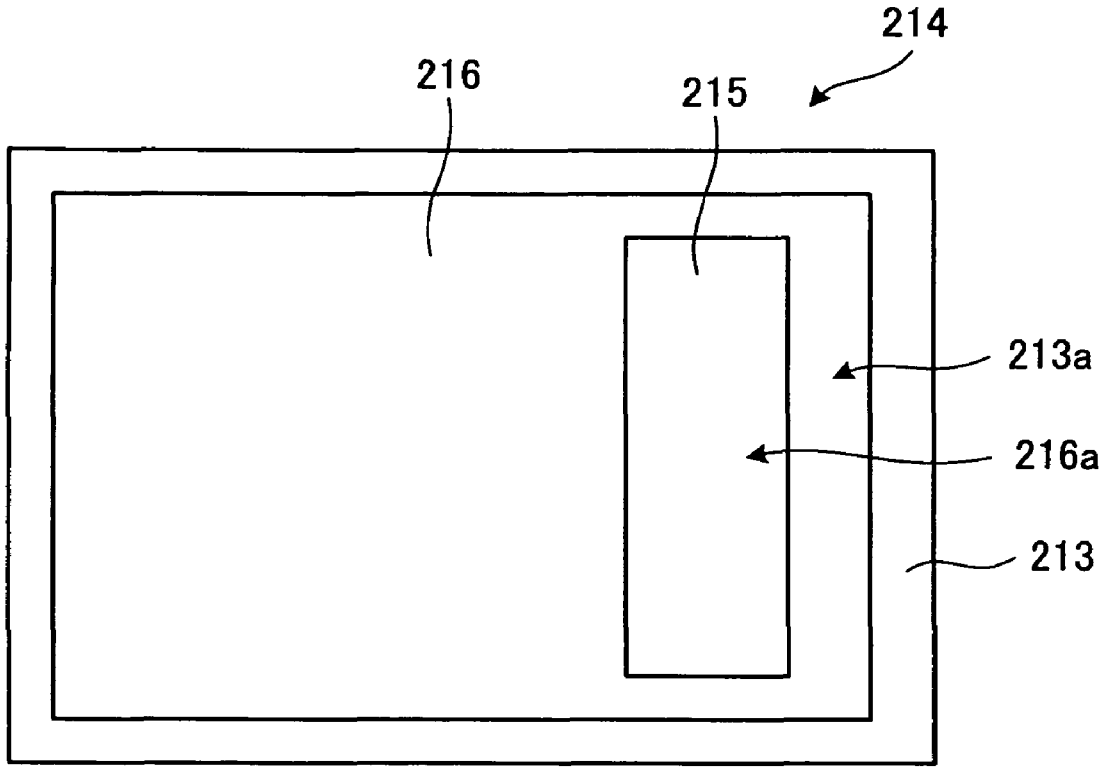
FIG. 9 illustrates a receiving tray viewed from the above.

In view of the above, a part of the absorber 214 for receiving Black ink adopts an absorber whose surface has a higher wettability than an absorber where ink of other colors is landed. FIG. 8 is a front view of the flushing region during the flushing operation. FIG. 9 illustrates the receiving tray viewed from above.

As illustrated in FIG. 8 and FIG. 9, the absorber 214 includes two types of absorbers: a first absorber 215 and a second absorber 216, whose surfaces have different surficial wettabilities respectively. The second absorber 216 is positioned in a recess 213 of the receiving tray 213. Further, the second absorber 216 has a recess 216*a* which opens upwardly. This recess 216*a* is in such a position that, while the carriage 202 is in the flushing region, the recess 216*a* faces a droplet ejection surface of the inkjet head 100, which surface has nozzles 4*d* for ejecting Black ink. In this recess 216*a* is positioned the first absorber 215.

The first and second absorbers 215 and 216 are made of different materials so that the surface wettability differs between the first and second absorbers 215 and 216. The absorbers 215 and 216 are both typically made of a versatile absorber such as urethane resin or melamine resin, and the materials are suitably selected so that the surface of the first absorber 215 (first adhesion region) has a higher wettability than that of the surface of the second absorber 216 (second adhesion region).

Further, the wettability of the surface of the first absorber 215 may be increased by forming a highly lyophilic film through a plasma treatment using oxygen gas for processing. That is, a droplet of ink dropped on to the surface of the first absorber 215 more easily wet-spreads on the surface of the first absorber 215 than a droplet dropped on the surface of the second absorber 216. Note that corona discharge, ozone discharge, or the like may be adopted as the surface treatment to increase the surface wettability of the first absorber 215. It is possible to perform the surface treatment with respect to an absorber having a high wettability.

As is understood from the above, the surface wettability of the first absorber 215 is easily made higher than that of the second absorber 216, by adopting as the first absorber 215 a material whose surface wettability is higher than that of the material for the second absorber 216. The same is done also by forming on the surface of the first absorber 215 a film having a higher wettability than that of the second absorber 216.

Thus, Black ink dropped on to the first absorber 215 wet-spreads on the surface of the first absorber 215, and is smoothened. That is, when the inkjet printer 200 moves the carriage 202 after the flushing operation and when the inkjet printer 200 causes ejection of Yellow ink from the nozzles 4*a* on Black ink adhered to the first absorber 215 during the above state, Yellow ink is able to land on a large area of Black ink. Further, the smoothened height of Black ink enables easier landing of Yellow ink, and Black ink is easily dissolved with a small amount of Yellow ink.

Figure 10A:
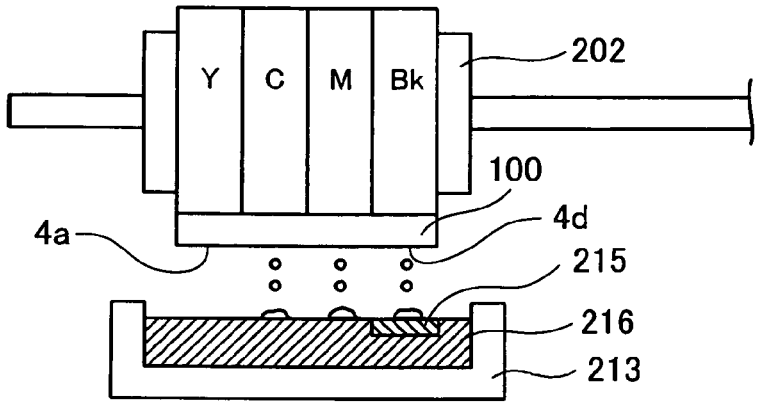
FIG. 10A is a front view illustrating the flushing region, and illustrating that the nozzles corresponding to three colors of ink other than Yellow ink are ejecting ink.

Next described is a series of operations taking place from the flushing operation to the subsequent process of dissolving Black ink on the first absorber 215. FIG. 10 illustrates a series of operations taking place from the flushing operation to the subsequent process of dissolving Black ink on the first absorber 215.

First, when a flushing operation command is input to the flushing control unit 62 during or before a recording operation, the inkjet printer 200 drives the carriage drive motor 219 with an aid of the flushing control unit 62 so as to move the carriage 202 to the left of FIG. 1 thereby bringing the inkjet head 100 to a position where the inkjet head 100 faces the receiving tray 213. Then, as illustrated in FIG. 10A, Black ink, Cyan ink, Magenta ink are ejected from the nozzles 4 including the second nozzles, while no ink is ejected from the nozzles 4*a* (first nozzle) for ejecting Yellow ink (the least solidifiable ink). As a result, Black ink adheres to the first absorber 215 and Cyan ink and Magenta ink adhere to the second absorber 216.

Figure 10B:
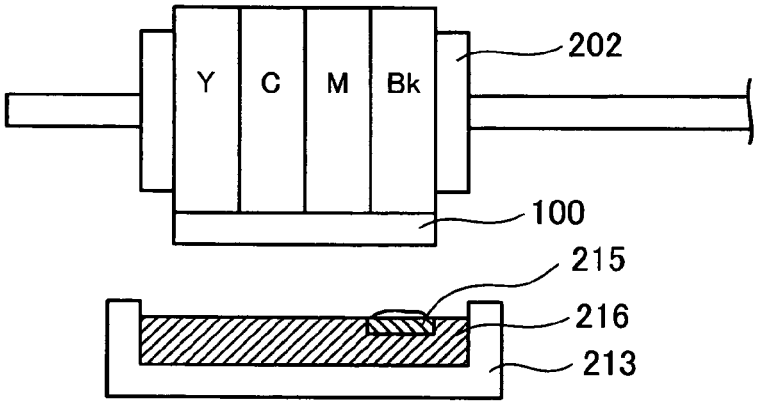
FIG. 10B is a front view illustrating the flushing region, and illustrating that the Black ink adhered to the first absorber is solidified.
Figure 10C:
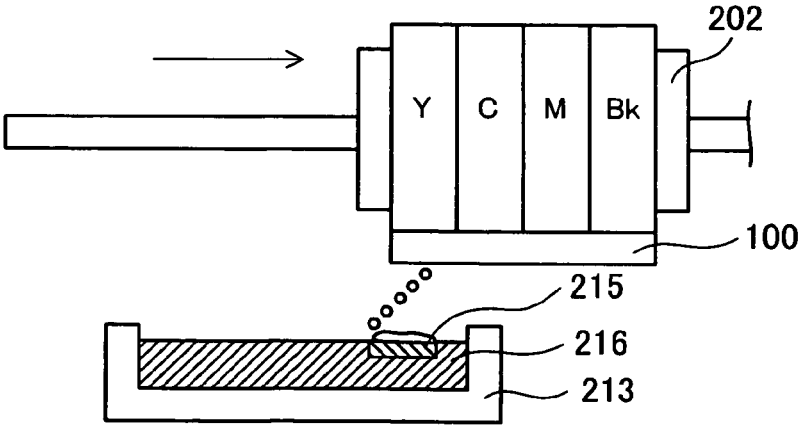
FIG. 10C is a front view illustrating the flushing region, and illustrating that the nozzles corresponding to Yellow ink are ejecting ink.

Then, as illustrated in FIG. 10B, cyan ink and magenta ink adhered to the second absorber 216 are absorbed in the second absorber 216. Black ink adhered to the first absorber 215 wet-spreads on the first absorber 215, and solidifies before being absorbed in the first absorber 215.

After the flushing operation, the inkjet printer 200 drives the carriage drive motor 219 with the aid of the flushing control unit 62, so as to move the carriage 202 to the right of FIG. 1. At this time, when the droplet ejection surface of the inkjet head 100 having nozzles 4*a* for ejecting Yellow ink faces the left end of the first absorber 215 in FIG. 1, the nozzles 4*a* for ejecting Yellow ink start ejecting droplets of Yellow ink. Then, the inkjet printer 200, while moving the carriage 202 to the right of FIG. 1, causes the nozzles 4*a* for ejecting Yellow ink to continuously eject droplets of Yellow ink up to the right end of the first absorber 215 in FIG. 1.

Through this, Yellow ink lands on Black ink having adhered and wet-spread on the first absorber 215, thereby dissolving the deposition of Black ink. As a result, Black ink is absorbed in the first absorber 215. Further, the deposition of Black ink having adhered to and wet-spread on the first absorber 215 is smoothened at this time. The quantity (height) of Black ink nearby an end of the deposition is almost the same as that nearby the vertex of the deposition. Accordingly, it is not necessary to control the amount of droplets of Yellow ink ejected from the nozzles 4*a* according to the position of the first absorber 215, while moving the carriage 202. The entire Black ink adhered to the first absorber 215 is easily dissolved simply by continuously ejecting a constant amount of Yellow ink from the nozzles 4*a*. Further, it is possible to easily dissolve the deposition of Black ink and leave less remnant, without a need of a complicated structure in which, for example, a sensor or the like for measuring and detecting a deposition of ink is provided to the ink receiving tray, and the amount of Yellow ink droplets to be ejected from the nozzles 4*a* is controlled for dissolving the deposition of ink.

Further, the flushing operation and the operation of dissolving Black ink adhered to the first absorber 215 are accomplished by performing only once the operation of ejecting the droplets of Yellow ink from the nozzles 4*a*. Thus, the consumption of Yellow ink droplets to be ejected from the nozzles 4*a* is reduced.

Further, the alignment of nozzles for Yellow ink (the least solidifiable ink) is in a position of the carriage farthest from the printing region relative to the scanning direction. Therefore, it is also possible to dissolve inks of other colors (Cyan and Magenta), in addition to Black ink.

Next the following describes alternative forms in which various modifications have been made. The members identical to the present embodiment are given the same symbols, and explanations therefore are omitted.

Figure 11:
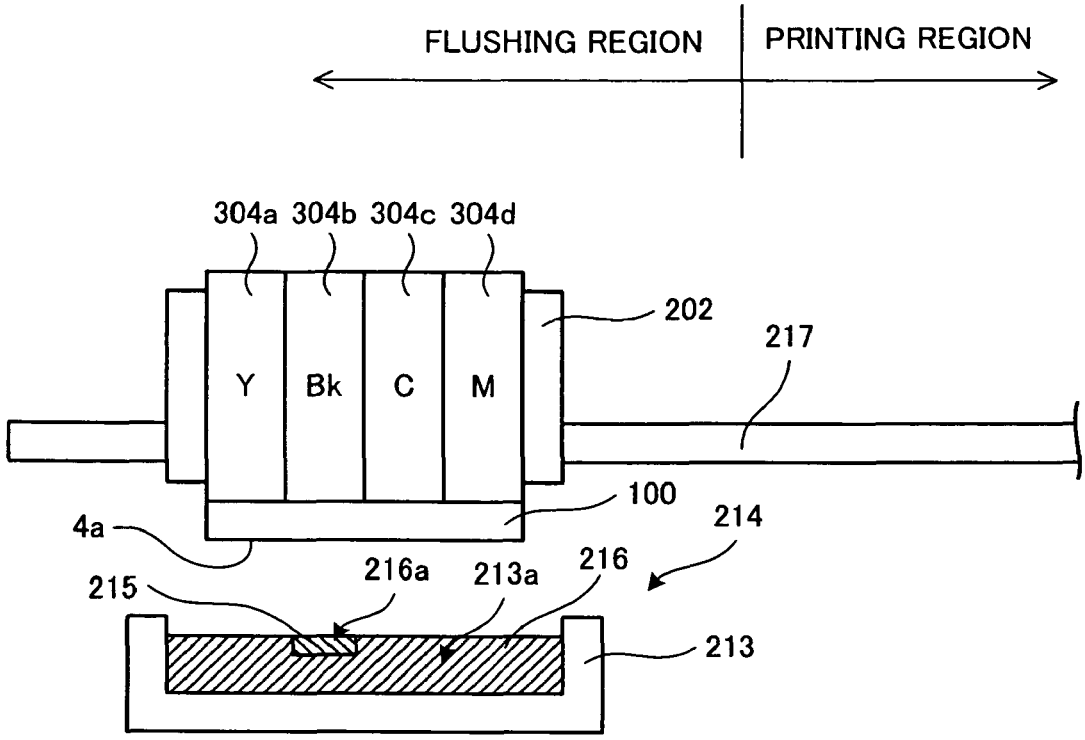
FIG. 11 is a diagram illustrating an alternative form of the absorber in the flushing region during the flushing operation.
Figure 12:
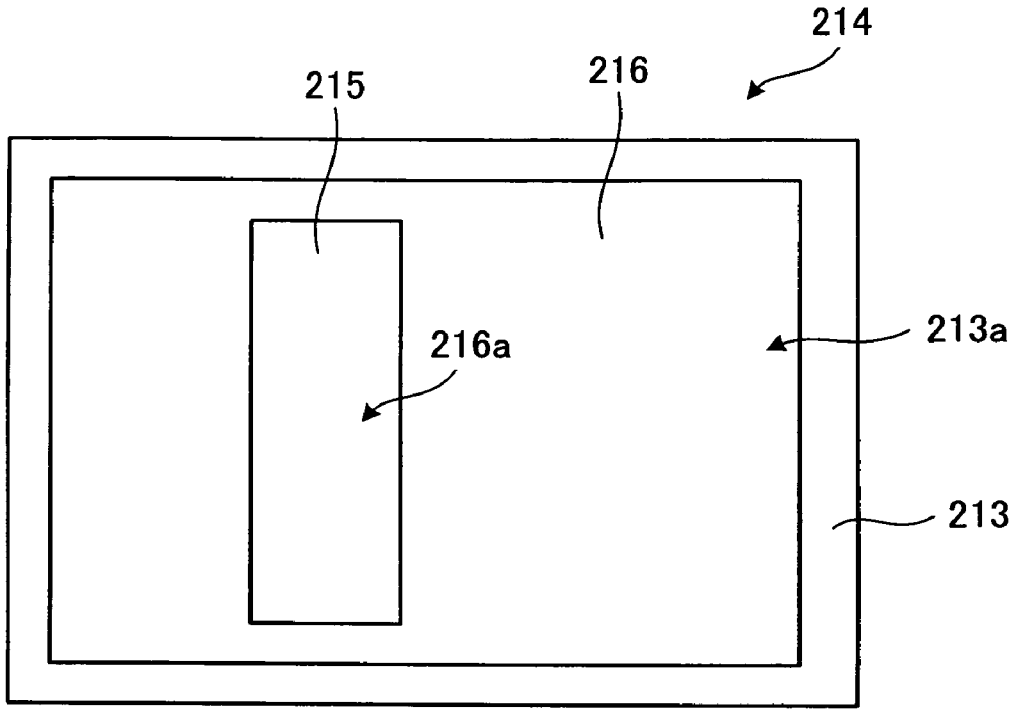
FIG. 12 illustrates the alternative form of the receiving tray viewed from the above.

In an alternative form, sub tanks 304*a* to 304*d* mounted on a carriage 202 are disposed in the scanning direction (Y-direction), which tanks respectively correspond to Yellow, Black, Cyan, and Magenta and are positioned in this order from the left of FIG. 11. Although not shown, to the sub tanks 304*a* to 304*d*, these colors of ink are supplied from ink cartridges via tubes, respectively. Rows of nozzles are formed on a nozzle plate 11 of a passage unit 1 of an inkjet head 100 so that the order of the rows is Yellow-Black-Cyan-Magenta, in which the row of Yellow ink is the closest to the viewer in FIG. 3. Note that there are two rows of nozzles which eject Black ink. In the same way as the above-described embodiment, pressure chambers, common ink chambers, dumper chambers, connection passages, through passages and the like are arranged so that the respective colors of ink are supplied to these nozzles. It should be also noted that pigment ink is used for Black ink, and dye ink is used for the other colors of ink. For a part of the absorber 214 (recess 216*a*) where the Black ink (most solidifiable ink) is dropped, used is an absorber 215 whose surface has a higher wettability than an absorber 216 where other colors of ink is dropped (see FIG. 12).

In other words, in the same way as the above-described embodiment, nozzles 4*a* (second nozzle) which eject Yellow ink (least solidifiable ink) is positioned farthest from a printing region in the scanning direction of the carriage 202, and nozzles 4*d* (first nozzle) which eject Black ink (most solidifiable ink) are positioned, in the scanning direction, adjacent to the nozzles 4*a* which eject the least solidifiable Yellow ink so that the nozzles 4*d* are closer to the printing region.

Thus, since the nozzles 4*d* are adjacent to the nozzles 4*a* which eject Yellow ink, it is possible to dissolve Black ink (the most solidifiable ink) simply by moving the carriage 202 in a direction approaching the printing region by a short distance, rather than in a direction departing from the printing region. Therefore, it is possible to downsize an inkjet printer 200 in relation to the moving direction of the carriage 202.

Figure 13A:
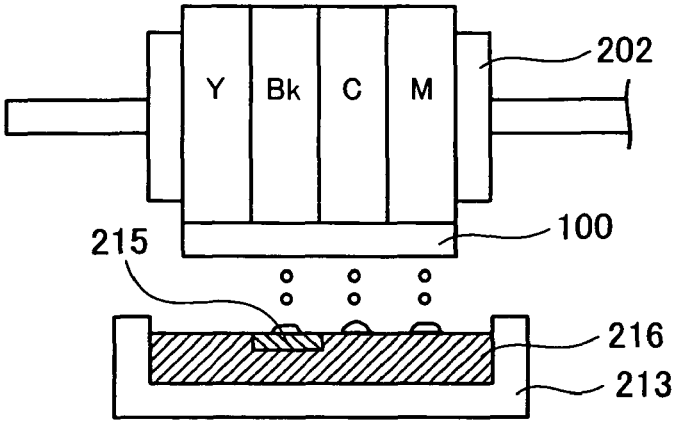
FIG. 13A is a front view illustrating the flushing region in an alternative form, and illustrating that the nozzles corresponding to three colors of ink other than Yellow ink are ejecting ink.
Figure 13B:
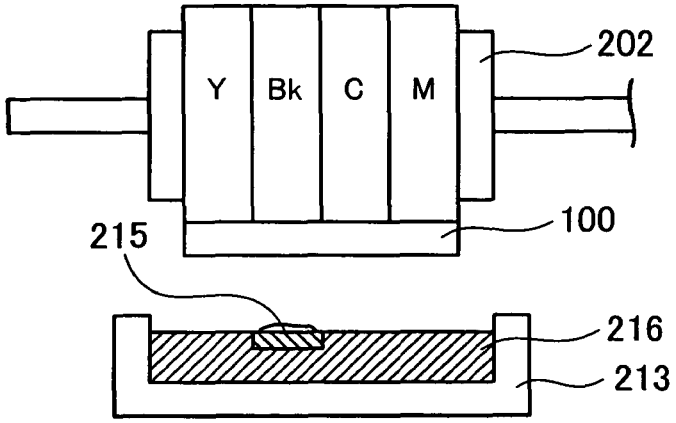
FIG. 13B is a front view illustrating the flushing region in an alternative form, and illustrating that the Black ink adhered to the first absorber is solidified.
Figure 13C:
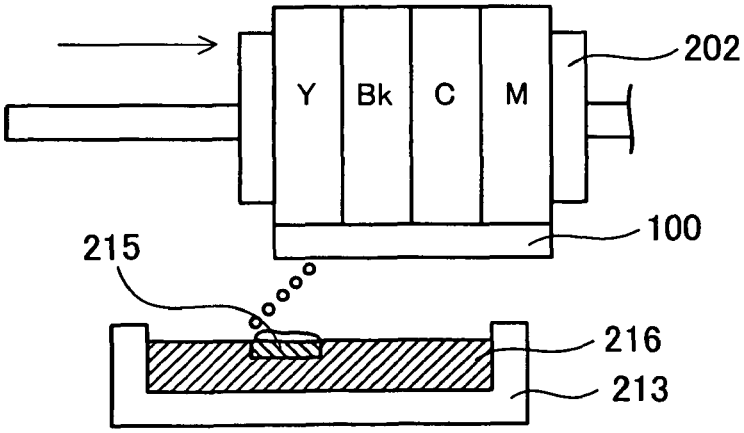
FIG. 13C is a front view illustrating the flushing region in an alternative form, and illustrating that the nozzles corresponding to Yellow ink are ejecting ink.

The distance moved by the carriage 202 after flushing operation is shorter, which results in reduction in movement time. This allows Yellow ink ejected from the nozzles 4*a* to be dropped promptly, before Black ink adhered to the absorber 215 is completely solidified, thereby improving the efficiency of dissolving Black ink (see FIG. 13A to FIG. 13C).

Figure 14A:
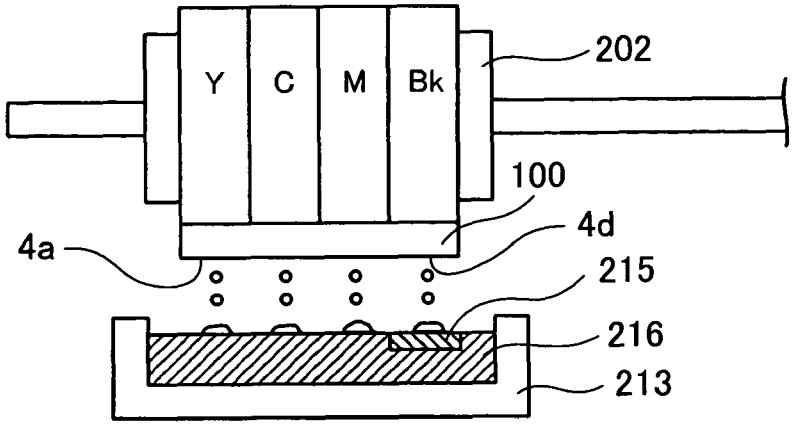
FIG. 14A is a front view illustrating the flushing region in an alternative form, and illustrating that all the nozzles are ejecting ink.
Figure 14B:
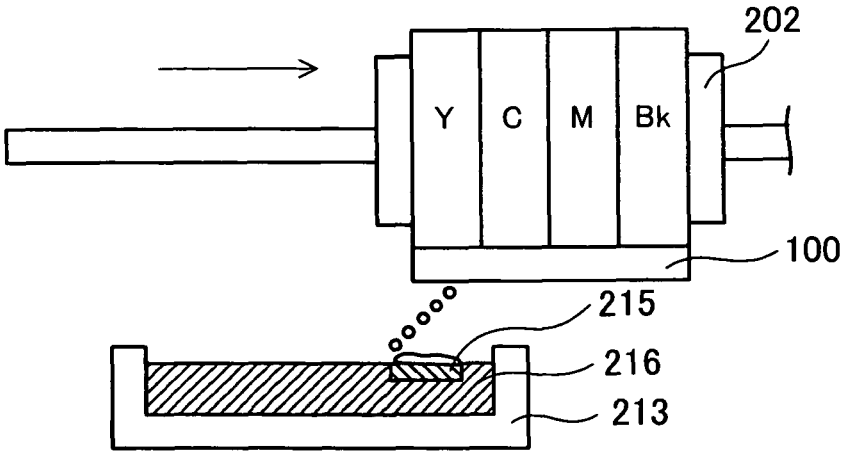
FIG. 14B is a front view illustrating the flushing region in an alternative form, and illustrating that the nozzles corresponding to Yellow ink is ejecting ink once again after the flushing operation.

Now, another alternative form will be described. In the above embodiment, Yellow ink is not ejected from the nozzles 4*a* at a time of flushing operation for other nozzles, but is ejected from the nozzles 4*a* for dissolving Black ink adhered to the first absorber 215. That is, such droplet ejection of Yellow ink also functions as flushing operation for the nozzles 4*a*. However, as shown in FIG. 14A, all colors of inks including Yellow ink may be ejected from all the nozzles 4 at a time of flushing operation, and then Yellow ink may be ejected again from the nozzles 4*a* for dissolving Black ink adhered to the first absorber 215, as shown in FIG. 14B. This makes it possible to easily dissolve Black ink adhered to the first absorber 215 without complicated control.

Further, the above embodiment has a structure such that: the nozzles for Yellow ink (the least solidifiable ink) are positioned farthest from the printing region in the scanning direction of the carriage; droplets of Yellow ink are dropped to a certain number of points in Black ink wet-spread over the absorber while moving the carriage 202; and Yellow ink is also ejected to the positions where the other colors of inks are landed. However, another structure is also possible such that: the carriage 202 is moved so that Yellow ink drops only to Black ink wet-spread over the first absorber 215, and is fixed at that position; and Yellow ink is dropped in that fixed position. This makes it possible to easily dissolve Black ink adhered to the first absorber 215 without complicated control.

In the above embodiment, pigment ink is used for Black ink, and dye ink is used for the other colors of inks which are Yellow, Cyan, and Magenta. However, the present invention can be applied for the case where the dye ink is used for all colors of inks. For example, in the case where the dye ink is used for all colors of inks, the solidifiability index of each ink type is shown in Table 2. This index adopts Black ink (Bk) as the norm and is obtained by computing the ratio of each ink constituent to a water content of each dye ink, and multiplying the ratio by a coefficient so that Black ink is 1.

TABLE 2

| | INDEX |
|---|---|
| Y | 0.3 |
| C | 0.31 |
| M | 0.29 |
| Bk | 1 |

Bk IS ADOPTED AS THE NORM (Bk IS 1)

In the case where dye ink is used for all colors of inks, the order of the rows of nozzles 4 is Magenta-Black-Yellow-Cyan, in which Magenta is for the row of nozzles 4 positioned farthest from the printing region when an inkjet head 100 is in a flushing region. It is possible to obtain advantageous effects of the present invention by ejecting the least solidifiable Magenta ink for dissolving Black ink (the most solidifiable ink) after the flushing operation.

Further, in the above embodiment, Black ink is dissolved by Yellow ink in each flushing operation. However, it is possible to dissolve a deposition of Black ink by Yellow ink at intervals of predetermined period of time or predetermined number of flushing operation, as long as a deposition of Black ink does not contact the nozzles 4. In addition, although in the above embodiment, only four types of ink (four colors of inks) are used, the present invention is applicable even if many more types of ink (not limited to the ink color) are provided. In that case, nozzles which eject the relatively least solidifiable ink among the plural types of ink are positioned farthest from the printing region in the scanning direction of the carriage, and nozzles which eject the most solidifiable ink are positioned adjacent to the nozzles which eject the least solidifiable ink. It is better to arrange the other types of ink in the order of solidifiability so that more hardly-solidifiable ink is positioned closer to the printing region.

Further, ink for dissolving the most solidifiable ink does not necessarily have to be the least solidifiable ink among the plural types of ink having different solidifiablities. Comparing two types of ink having different solidifiabilities, the less-solidifiable ink may be used for dissolving the more-solidifiable ink. That is, ink to be dissolved does not have to be the most solidifiable ink among the plural types of ink, and ink for use in dissolving another type of ink does not have to be the least solidifiable ink among the plural types of ink.

It should be noted that the shape, size, and position of the ink receiving tray are not limited to the arrangement in the above embodiment, and various modifications are possible.

In the above-described embodiment, adopted is an inkjet head which is structured by stacking the piezoelectric actuator onto the passage unit. However, the present invention is not limited to such a structure, and various types of inkjet heads are applicable as long as the inkjet head has a passage unit for ejecting ink from a nozzle and an energy element for ejecting ink (e.g., a thermal energy element).

In the above embodiment, the ink receiving tray is disposed in an area beyond the width of a sheet in the Y-direction (outside of the printing region) and flushing operation is performed in that area. Accordingly the embodiment provides an advantageous effect of downsizing the main body of the apparatus. However, even in the case where, for example, an absorber is provided on a platen disposed below the printing region of the carriage and flushing operation is performed in the printing region, adopting the arrangement of nozzles of this embodiment and the alternative forms enables a deposition of easily-solidifiable ink to be dissolved effectively by using hardly-solidifiable ink.

The above embodiment deals with an inkjet-type printer which records an image or the like by ejecting ink onto a recording sheet; however, the application of the present invention is not limited to such a printer, but the present invention is applicable to various of droplet ejection devices which eject various types of liquid to an object, depending on the purpose.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A droplet ejection device, comprising:

a carriage which is capable of moving back and forth in a predetermined direction;

a droplet ejection head which is mounted on the carriage and has plural nozzles arranged in the predetermined direction which nozzles eject plural types of liquids in the form of droplets;

a control unit configured to move the carriage in the predetermined direction, and to cause the droplet ejection head to perform an ordinary ejection operation and a flushing operation, wherein (i) the ordinary ejection operation is an operation of ejecting a droplet from at least one of the nozzles, in an ordinary ejection region within a moveable range of the carriage, and (ii) the flushing operation is an operation of ejecting a droplet from at least one of the nozzles in a flushing region outside the ordinary ejection region;

a droplet receiver positioned in the flushing region, which receives a droplet ejected from at least one of the nozzles during the flushing operation, wherein the plural types of liquids ejected in the form of droplets are distinguishable into two or more ranks in terms of how easily solidification occurs after adhering to the droplet receiver;

the plural nozzles includes a first nozzle which ejects a droplet of the first liquid and a second nozzle which ejects a droplet of the second liquid which is less solidifiable than the first liquid;

the control unit, during the flushing operation, is configured to cause the droplet ejection head to eject a droplet of the first liquid from the first nozzle, cause the carriage to move in the predetermined direction so that a droplet to be ejected from the second nozzle drops onto a part of the droplet receiver having received the droplet from the first nozzle, and then cause the droplet ejection head to eject a droplet of the second liquid from the second nozzle; and among the plural nozzles, the second nozzle is positioned farthest from the ordinary ejection region in the predetermined direction while the droplet ejection head is in the flushing region wherein the surface of a part of the droplet receiver which receives a droplet of the first liquid has higher wettability than that of the surface of a part of the droplet receiver which receives a droplet of the second liquid.

2. The droplet ejection device according to claim 1, wherein, among the plural nozzles, the first nozzle is adjacent to the second nozzle.

3. The droplet ejection device according to claim 1, wherein dye ink is ejected from the second nozzle, and pigment ink is ejected from the first nozzle.

4. The droplet ejection device according to claim 1, wherein the control unit, during the flushing operation, is configured to cause the droplet ejection head to eject droplets from the plural nozzles, cause the carriage to move in the predetermined direction so that a droplet to be ejected from the second nozzle drops onto a part of the droplet receiver having received a droplet ejected from the first nozzle, and then cause the droplet ejection head to eject a droplet of the second liquid from the second nozzle.

5. The droplet ejection device according to claim 1, wherein the control unit, during the flushing operation, is configured to cause the droplet ejection head to eject droplets from the plural nozzles other than the second nozzle, cause the carriage to move in the predetermined direction so that a droplet to be ejected from the second nozzle drops onto a part of the droplet receiver having received a droplet ejected from the first nozzle, and then cause the droplet ejection head to eject a droplet of the second liquid from the second nozzle.

6. The droplet ejection device according to claim 1, wherein the first liquid is the most solidifiable liquid, and the second liquid is the least solidifiable liquid, among the plural types of liquids ejected in the form of droplets.

7. A droplet ejection device, comprising:

a carriage which is capable of moving back and forth in a predetermined direction;

a droplet ejection head which is mounted on the carriage and has plural nozzles arranged in the predetermined direction which nozzles eject plural types of liquids in the form of droplets;

a control unit configured to move the carriage in the predetermined direction, and to cause the droplet ejection head to perform an ordinary ejection operation and a flushing operation, wherein (i) the ordinary ejection operation is an operation of ejecting a droplet from at least one of the nozzles, in an ordinary ejection region within a moveable range of the carriage, and (ii) the flushing operation is an operation of ejecting a droplet from at least one of the nozzles in a flushing region outside the ordinary ejection region;

a droplet receiver positioned in the flushing region, which receives a droplet ejected from at least one of the nozzles during the flushing operation, wherein the plural types of liquids ejected in the form of droplets are distinguishable into two or more ranks in terms of how easily solidification occurs after adhering to the droplet receiver;

the plural nozzles includes a first nozzle which ejects a droplet of the first liquid and a second nozzle which ejects a droplet of the second liquid which is less solidifiable than the first liquid;

the control unit, during the flushing operation, is configured to cause the droplet ejection head to eject a droplet of the first liquid from the first nozzle, cause the carriage to move in the predetermined direction so that a droplet to be ejected from the second nozzle drops onto a part of the droplet receiver having received the droplet from the first nozzle, and then cause the droplet ejection head to eject a droplet of the second liquid from the second nozzle; and among the plural nozzles, the second nozzle is positioned farthest from the ordinary ejection region in the predetermined direction while the droplet ejection head is in the flushing region wherein the surface of a part of the droplet receiver which receives a droplet of the first liquid has higher wettability than that of the surface of a part of the droplet receiver which receives a droplet of the second liquid, wherein; the droplet receiver has a porous absorber for absorbing droplets; and the absorber includes a first absorber and a second absorber having a different wettability from that of the first absorber.

* * * * *